US005441761A

United States Patent [19]

Miller

[11] Patent Number: 5,441,761

[45] Date of Patent: Aug. 15, 1995

[54] METHOD FOR THE PARTIAL METALLIZATION OF A SUBSTRATE

[75] Inventor: Lee H. Miller, Greenwich, Conn.

[73] Assignee: Alusit Holdings, L.P., Greenwich, Conn.

[21] Appl. No.: 338,277

[22] Filed: Nov. 14, 1994

Related U.S. Application Data

[63] Continuation of Ser. No. 90,913, Jul. 12, 1993, abandoned.

[51] Int. Cl.[6] ..... B05D 1/28; B05D 5/00; B44C 1/10

[52] U.S. Cl. ..... 427/146; 427/192; 427/203; 427/205; 427/404; 156/230

[58] Field of Search ..... 427/192, 203, 205, 146, 427/404, 440; 156/230

[56] References Cited

U.S. PATENT DOCUMENTS 4,153,494 5/1979 Vilaprinyo Oliva ..... 156/230
4,183,975 1/1980 Sidders ..... 427/50
4,215,170 7/1980 Vilaprinyo Oliva ..... 428/328
4,420,515 12/1983 Amon et al. ..... 428/29
4,777,081 10/1988 Crass et al. ..... 428/215
4,904,325 2/1990 Crass et al. ..... 427/404

*Primary Examiner*—Shrive Beck
*Assistant Examiner*—Brian K. Talbot
*Attorney, Agent, or Firm*—Lieberman & Nowak

[57] ABSTRACT

A process for the selective metallization of a substrate and the product formed thereby. An extremely thin (substantially less than the wavelength of light) coat of metallic particles is deposited on a transfer agent. A thin coat of varnish is selectively applied to either the substrate or the transfer agent, the substrate and the transfer agent are laminated together and the varnish is cured. The metallic particles will become absorbed within the varnish and the substrate and transfer agent are then separated. The substrate is provided with a highly polished specular metallic finish in predetermined areas.

3 Claims, 2 Drawing Sheets

METHOD FOR THE PARTIAL METALLIZATION OF A SUBSTRATE

This application is a continuation of application Ser. No. 08/090,913, filed Jul. 12, 1993, now abandoned.

FIELD OF THE INVENTION

This invention relates generally to a process for the partial metallization of a substrate, and the article produced thereby.

BACKGROUND OF THE INVENTION

Metallization processes in general are well known and have been used for an extended period in various industries. For example, in the food and tobacco industries, there are numerous products which are wrapped in metallized liners to preserve freshness, to protect against environmental factors such as radiation, or to improve the aesthetics of packaging. Similarly, in the greeting card and decorative wrapping industries, metallized substrates have been used to provide unique designs of various types.

One such metallization process has been described in U.S. Pat. No. 4,215,170, the teachings of which are incorporated herein by reference. U.S. Pat. No. 4,215,170 is owned by the asignee of the instant application.

The method of U.S. Pat. No. 4,215,170 is directed to providing a smooth specular surface that is independent of the smoothness of the substrate or the metal, without the need for pretreatment of the substrate, and without exposing the substrate to a vacuum. The method involves depositing an extremely thin coat of metallic particles on a transfer agent. A thin coat of varnish is applied to either the substrate or transfer agent, and the two are laminated together before the varnish has cured. The metallic particles are absorbed or embedded within the varnish coat, which will provide the substrate with the appearance of a specular metallic finish. After the varnish has cured, the transfer agent and substrate are separated.

However, even though the method described in U.S. Pat. No. 4,215,170 was a substantial improvement over prior art metallization methods, it did not provide for the selective metallization of a substrate in order to provide decorative patterns, or to provide metallization in selected areas in order to reduce expense while retaining the effectiveness of the inventive metallization process.

SUMMARY OF THE INVENTION

Generally speaking, the present invention provides a process for the partial metallization of a substrate and the product formed thereby. In carrying out one embodiment of the invention, an extremely thin coat of metallic particles is deposited on the transfer agent. A selected varnish layer is then applied to the substrate or to the transfer agent (plastic film), or both, in discrete strips. The transfer agent and the substrate are laminated together before the varnish is cured. The metallic particles will become absorbed or embedded within the varnish coat, which will bond them in strips to the substrate, thus providing discrete metal strips or particular patterns with the appearance of a specular metallic finish on the substrate. After the varnish has cured, the transfer agent and substrate are separated.

In another embodiment, the entire plastic film (or transfer agent) is coated with metallic-particles and the varnish is applied to a predetermined area of either the substrate or the transfer agent. Accordingly, during lamination of the substrate and transfer agent, the metallic particles are removed from the transfer agent in the predetermined area corresponding to the varnish. Again, a substrate with a discrete metallized area is formed after curing of the varnish and separation of the transfer agent. The transfer agent, which is still partially coated with metallic particles, may be reused numerous times to provide additional substrates with metallized areas.

Hence, it is an object of this invention to provide a substrate with a thin metallic coating in discrete strips, areas, or patterns so as to provide a larger yield of coated substrate from the metal and significantly reduce the cost of material.

It is a further object of this invention to provide a process for the production of a substrate that is partially coated with a specular gloss equivalent to that of metallic foil at economies substantially less than that of foil laminates.

Another object of this invention is to provide a substrate partially coated with metallic particles having a chemical resistance approaching that of metallic foil that does not yellow or change in appearance with the passage of time, that is abrasion resistant, flexible and hard so as to withstand various production and printing processes, and that can be printed upon.

Still another object of this invention will become apparent upon a reading of the detailed specification to follow.

BRIEF DESCRIPTION OF THE DRAWINGS

For a better understanding of the invention, reference is made to the following drawings, taken in connection with the specification.

DESCRIPTION OF THE PREFERRED EMBODIMENTS

Figure 1:
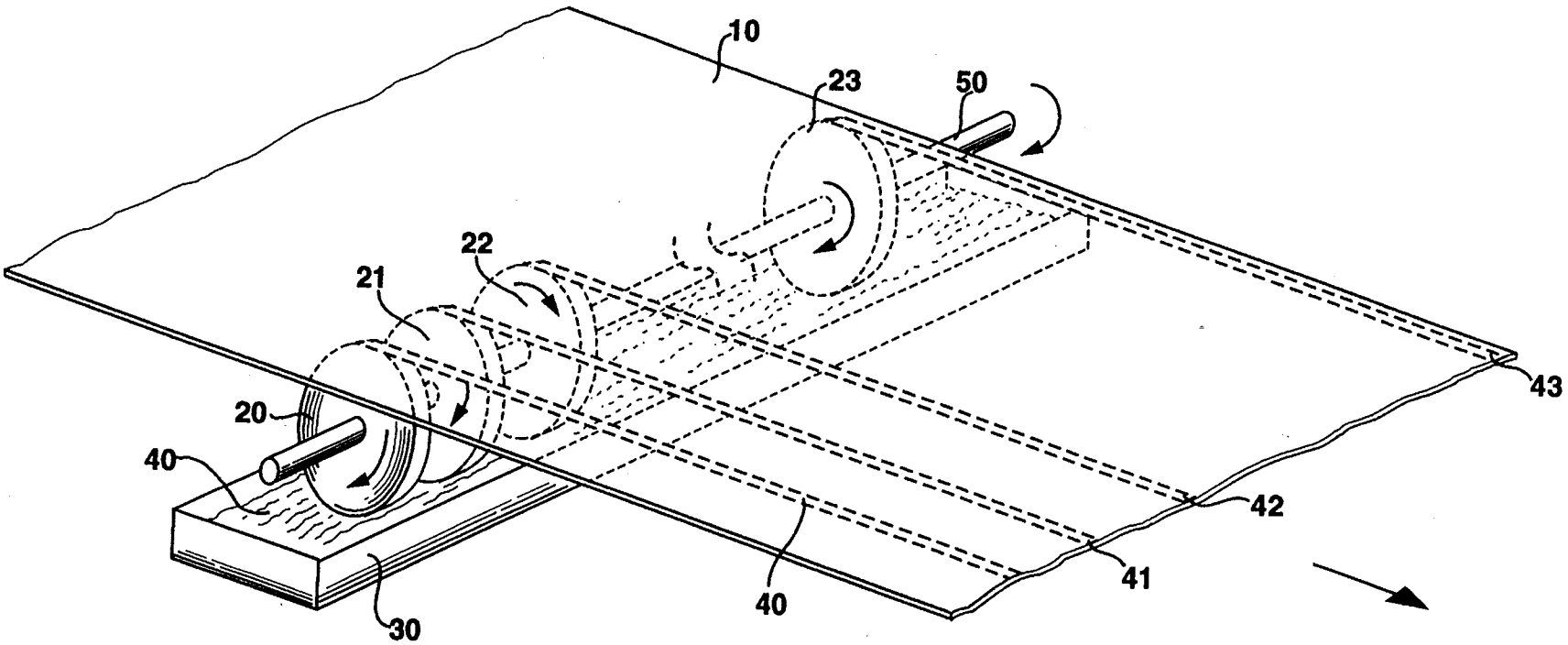
FIG. 1 illustrates varnish being applied in selected areas to a substrate.

The present invention provides a process for the partial metallization of a substrate and the product formed thereby. Initially, an extremely thin coat of metallic particles is deposited on the transfer agent. Next, a varnish layer is applied to the substrate, or to a transfer agent in discrete areas or strips. The transfer agent and the substrate are then laminated together before the varnish is cured. The metallic particles will become absorbed or embedded within the varnish coat, which will bond them in strips, or in the predetermined areas, to the substrate, thus providing discrete metal areas or strips with the appearance of a specular metallic finish on the substrate. After the varnish has cured, the transfer agent and substrate are separated. The steps of metal deposition, lamination and curing are described in U.S. Pat. No. 4,215,170.

In the practice of the present invention, the surface of the plastic film or transfer agent that will be laminated against the substrate should be glossy, polished and finely finished since this surface will affect the final surface impart to the substrate. In embodiments where the metal particles are first applied to the film and then transferred to the substrate, the film must have an adherence to the metal particles less than that of the varnish to be employed. Suitable materials for the transfer agent are untreated polypropylene, polyester, polyethylene, polyvinylchloride, polyamide, co-extrusates and regenerated cellulose, among others, with a preferred material being described below.

The plastic film or substrate is metallized by the deposition of metallic particles by any known process such as vacuum metallization, chemical precipitation and other coating techniques. Suitable metals for deposition are aluminum, copper, silver, nickel, tin, platinum, gold, their alloys and other vaporizable metals. The quantity of metal deposition will be monitored so that the metal particles deposited will build to an extremely thin layer. The deposited particles will have a thickness of substantially less than the wavelength of light, and a spacing (where such spacing or metal film apertures occur by virtue of the layer thinness) substantially less than that of the wavelength of visible light. Accordingly, the light is substantially reflected from the metallic surface and the metallic surface appears continuous and exhibits a fully specular metallic surface.

The substrate, which will eventually be coated with the metallic particles, may be in web or sheet form, and have a rough or smooth surface. Suitable substrates are paper, cardboard, wood, leather, plastic and, in fact, any sheeting material capable of being varnish coated. A suitable varnish for this step is polyurethane varnish. The varnish serves both as a vehicle for producing (in conjunction with the transfer agent) a smooth, specular surface, and as an adhesive which transfers and bonds the metallic particles to the substrate. The varnish also serves to level and smooth the surface of the substrate. It is a feature of this invention that while the varnish will adhere to the substrate, it will not adhere to the transfer agent.

The coating of varnish may be applied over the deposited metal particles, or over the opposing surface which will be laminated against the particles. The finished products from the two procedures are substantially identical.

The laminating step takes place before the varnish has had a chance to cure. In this step, the substrate is brought into contact with the metallic-coated surface of the transfer agent. This is preferably accomplished by rolling the substrate and the film into a single roll under slight pressure. This step is similar to a conventional lamination process. The varnish will transfer the metallic particles from the film to the substrate. The varnish will absorb the metallic particles and will take on the smooth surface characteristics of the film once it is removed.

The laminated substrate and film may be cured by air drying, conventional curing processes, or electron beam curing. Once the varnish has set, dried or polymerized, it does not bond to the film, but bonds strongly to the substrate. The curing step may be natural or accelerated by heat or exposure to radiation. After curing, separation takes place. The film or transfer agent and the substrate may be separated onto two separate rollers. The varnish and its absorbed or embedded metallic particles will adhere to the substrate. After separation, the film or transfer agent may be reused a number of times, thereby rendering extraordinary economic advantages.

The finished substrate will have a smooth, specular, metallic coating which appears continuous and smooth, because any interstices or spaces between the metallic particles permit little light transmission (i.e., less than 30% preferably less than 20%). The finished product may be subjected to various other processes such as cutting, embossing, die-stamping, slitting and printing on the metallized surface with various printing systems such as offset, rotogravure, flexographic, silk screen and others.

Referring now to FIG. 1, there is shown one method of selectively applying varnish in strips to a substrate for the purpose of accomplishing the metallization process described above.

More particularly, substrate 10 is arranged to pass over rollers 20, 21, 22 and 23, which rollers are selectively attached to shaft 50. It is, of course, understood that apparatus (not shown) would be arranged to rotate the rollers 20–23 in the direction shown, and that substrate 10 would be driven by appropriate apparatus (not shown) to pass the substrate over the rollers.

Rollers 20–23 are immersed in a varnish bath with the bath being indicated at 30, and the varnish shown as 40. As the rollers rotate in the direction indicated, varnish is picked up from the varnish bath and applied to the rollers. Substrate 10 picks up the varnish in selected strips shown as strips 40, 41, 42 and 43. Thereafter, the varnish strips are laminated with an appropriate metallized film as described above to produce selected metallized strips on a finished substrate.

Figure 3:
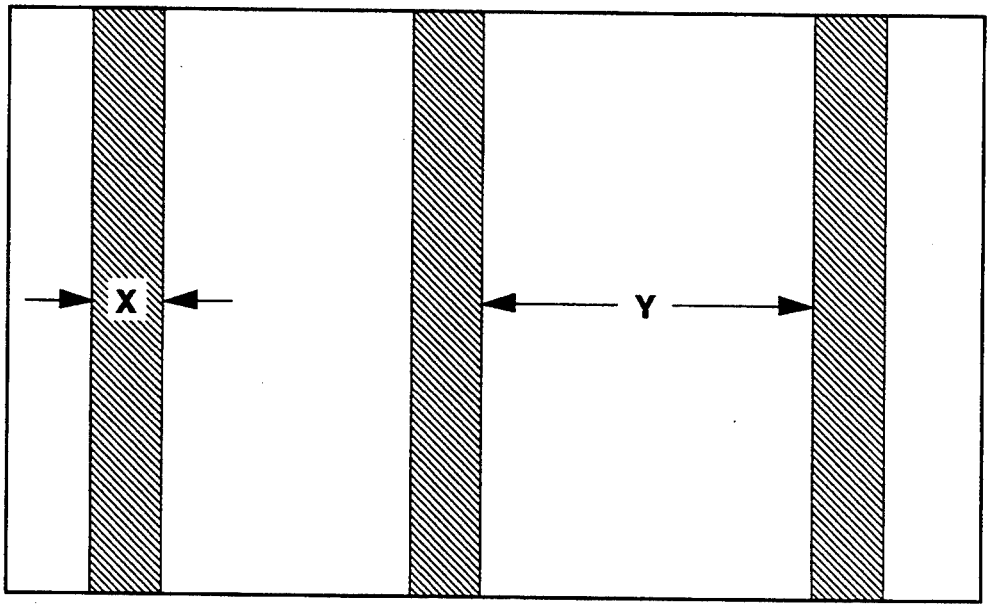
FIG. 3 illustrates how selected areas of varnish may be applied to a substrate which vary in width, or vary in terms of the distance between the selected areas.

In order to change the width of the varnish strips, or the distance between the varnish strips, several different techniques may be employed. For example, to change the width of the strips (x) (see FIG. 3), it would only be necessary to replace the rollers with rollers of the desired width. Similarly, to change the distance between strips (y) (see FIG. 3) various methods may be used. One method is to allow the rollers to be selectively moved along shaft 50. Another method is to provide a separate varnish bath for each roller, and fill or empty a particular bath to selectively apply the varnish to a particular roller and leave other rollers varnish free.

It is, of course, understood that if the metallized film is completely metallized, the rollers would be moved to compensate for metal removed from the film on prior passes of the substrate and the film through the laminator. In this manner, the film can be reused numerous times to greatly increase the economy of the inventive metallization process. It is also understood that the film (or substrate) itself could be shifted side-to-side in order to adjust for metal used in prior passes through the laminating device.

Figure 2:
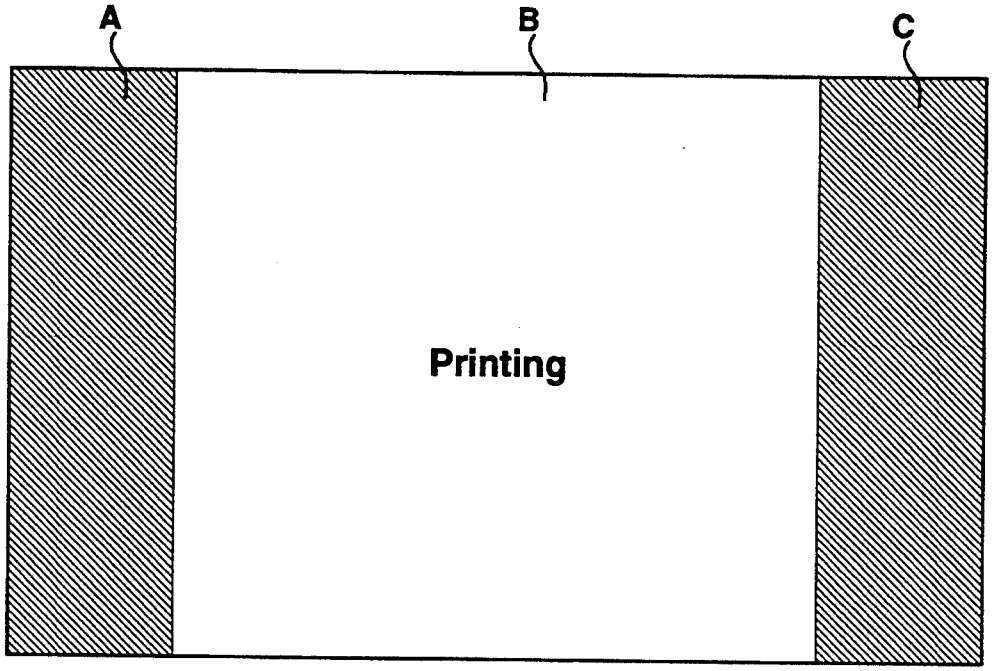
FIG. 2 illustrates a combination of metallization and printing in accordance with the instant invention.

Referring now to FIG. 2, there is shown one embodiment in which metallized areas (A and C) are placed adjacent to an area (B) which can be used to print consumer related information. This embodiment is particularly useful for cigarette packaging in which metallized areas would be placed on the ends of each package of cigarettes and the printed area would consist of consumer related information.

Although, as described above, various parameters may be useful with the use of the present invention, the following would be exemplary. The transfer agent is preferably untreated BOPP film. This film, because it is orientated, more stable and less subject to stretching, gives a better flat lay-down than other films. The surface of the untreated BOPP is very smooth and results in more brilliance and reflectivity then other films. The use of untreated BOPP gives the greatest reuse factor, resulting in enhanced performance and process economics. Only with untreated BOPP will the metal adhere perfectly to the adhesive compared to the film itself.

The second element important to the instant invention is the use of adhesive coating weights of between 8 and 10 grams per square meter. Using an adhesive weight of more than 10 grams per square meter may cause problems in solvent elimination. This results in poor adhesion of the metal layer and could also show up in offset printing where trapped solvent could attack the printing inks making the surface unprintable. Conversely, utilizing less than 8 grams per square meter typically results in inadequate metal transfer from the film to the adhesive with a very poor quality appearance, a dull graying effect, and patches of unmetallized or small white spots. Accordingly, providing an adhesive coating weight of between 8–10 grams per square meter results in substantial cost savings, as well as a more uniform and higher quality product.

A third element to consider is the amount of metallization. Up to 1,000 Angstroms in metallization thickness can be used, but the preferred range is between 50 and 200 Angstroms. The use of less metallization can result in a faster and more economical process without degradation in the visual appearance of the final product.

Although the present invention has been described in conjunction with preferred embodiments, it is to be understood that modifications and variations will become apparent to those skilled in the art upon a reading of this disclosure. Such modification and variations are considered to be within the spirit and scope of the invention and the appended claims.

What is claimed is:

1. A process for the partial metallization of a substrate employing a reusable untreated bi-oriented polypropylene plastic film comprising:

a) depositing on the bi-oriented polypropylene plastic film, metal particles of between 50 and 200 Angstroms in thickness;

b) coating a selected portion of said substrate or said plastic film with varnish, said varnish being utilized with a coating weight of between 8–10 grams per square meter;

c) laminating the substrate and the plastic film together before the varnish is cured so that the metal particles are embedded in the varnish;

d) curing said varnish so that it bonds to the substrate;

e) separating the plastic film from the substrate; and f) reusing said plastic film; whereupon said substrate is provided with at least one strip of the film of metal particles, and wherein said deposited particles have a thickness substantially less than the wavelength of light and a spacing substantially less than the wavelength of visible light whereby the metallic surface appears continuous and exhibits a specular metallic finish.

2. The process of claim 1, wherein said plastic film of step (a) may be reused to provide additional strips of metal particles to a substrate in accordance with steps (b) through (f).

3. The process of claim 2, wherein said substrate is selected from the group consisting of paper, cardboard, wood, leather and plastic.

* * * * *